US012435586B2

(12) United States Patent
Ewing et al.

(10) Patent No.: US 12,435,586 B2
(45) Date of Patent: Oct. 7, 2025

(54) ANCHOR SYSTEM AND METHOD

(71) Applicant: Baker Hughes Oilfield Operations LLC, Houston, TX (US)

(72) Inventors: Daniel Ewing, Katy, TX (US); Jason Harper, Cypress, TX (US); Guijun Deng, The Woodlands, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/348,147

(22) Filed: Jul. 6, 2023

(65) Prior Publication Data

US 2025/0012156 A1 Jan. 9, 2025

(51) Int. Cl.
*E21B 23/01* (2006.01)

(52) U.S. Cl.
CPC ..... *E21B 23/01* (2013.01)

(58) Field of Classification Search
CPC ..... E21B 23/01; E21B 23/04; E21B 23/0411; E21B 23/04115; E21B 23/0412
See application file for complete search history.

(56) References Cited

U.S. PATENT DOCUMENTS 4,548,264 A * 10/1985 Manderscheid .... E21B 33/1292 166/216
4,708,202 A * 11/1987 Sukup ..... E21B 33/1204 166/123
7,255,178 B2 8/2007 Slup et al.
10,450,840 B2 10/2019 Xu
2002/0121160 A1* 9/2002 Bangert ..... E21B 19/10 81/57.5
2002/0136904 A1* 9/2002 Glass ..... E21B 21/103 428/426
2007/0039741 A1* 2/2007 Hailey, Jr. ..... E21B 43/08 166/228
2013/0213665 A1 8/2013 O'Malley
2014/0190685 A1* 7/2014 Frazier ..... E21B 33/129 166/135
2015/0129215 A1* 5/2015 Xu ..... C22C 1/0408 166/285
2016/0160592 A1* 6/2016 Zhang ..... E21B 23/06 166/382

(Continued)

FOREIGN PATENT DOCUMENTS

CA 2944515 A1 10/2015

OTHER PUBLICATIONS

Glass, et al.; "Stressed Glass Technology for Actuators and Removable BarrierApplications"; Sandia Report, SAND2007-4106, Unlimited Release, Printed Jul. 2007; 18 pages.

(Continued)

*Primary Examiner* — Cathleen R Hutchins
(74) *Attorney, Agent, or Firm* — CANTOR COLBURN LLP

(57) ABSTRACT

An anchor system including a slip, and a cone supportive of the slip in a set position, the cone being configured to reduce structural integrity thereof upon receipt of a signal. A method for operating an anchor including sending a signal to an anchor, and reducing the structural integrity of the cone. A borehole system including a borehole in a subsurface formation, a string in the borehole, and an anchor, disposed within or as a part of the string.

20 Claims, 6 Drawing Sheets

(56) References Cited

U.S. PATENT DOCUMENTS

| | | | | |
|---|---|---|---|---|
| 2017/0234103 | A1 | 8/2017 | Frazier | |
| 2017/0306711 | A1* | 10/2017 | Hern | E21B 29/06 |
| 2018/0171736 | A1 | 6/2018 | Xu et al. | |
| 2018/0283141 | A1 | 10/2018 | Zhang et al. | |
| 2020/0157912 | A1 | 5/2020 | Mhaskar | |
| 2021/0062609 | A1 | 3/2021 | Takahashi et al. | |
| 2024/0318518 | A1* | 9/2024 | Solyom | E21B 33/12 |

OTHER PUBLICATIONS

Notification of Transmittal of the International Search Report and Written Opinion of the International Searching Authority, or the Declaration; PCT/US2024/036628; Mail date Oct. 10, 2024; 10 pages.

* cited by examiner

ANCHOR SYSTEM AND METHOD

BACKGROUND

In the resource recovery and fluid sequestration industries anchoring systems are prevalent. Removing anchoring systems is also prevalent and generally requires a mechanical tensile load applied to the system to overcome engagement of the system with a tubular structure. Significant tensile load is generally required and damage is not unusual. The art would well receive alternate technologies that support reliable anchoring while simultaneously enable easier withdrawal with comparatively less damage.

SUMMARY

An embodiment of an anchor system including a slip, and a cone supportive of the slip in a set position, the cone being configured to reduce structural integrity thereof upon receipt of a signal.

An embodiment of a method for operating an anchor including sending a signal to an anchor, and reducing the structural integrity of the cone.

An embodiment of a borehole system including a borehole in a subsurface formation, a string in the borehole, and an anchor, disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
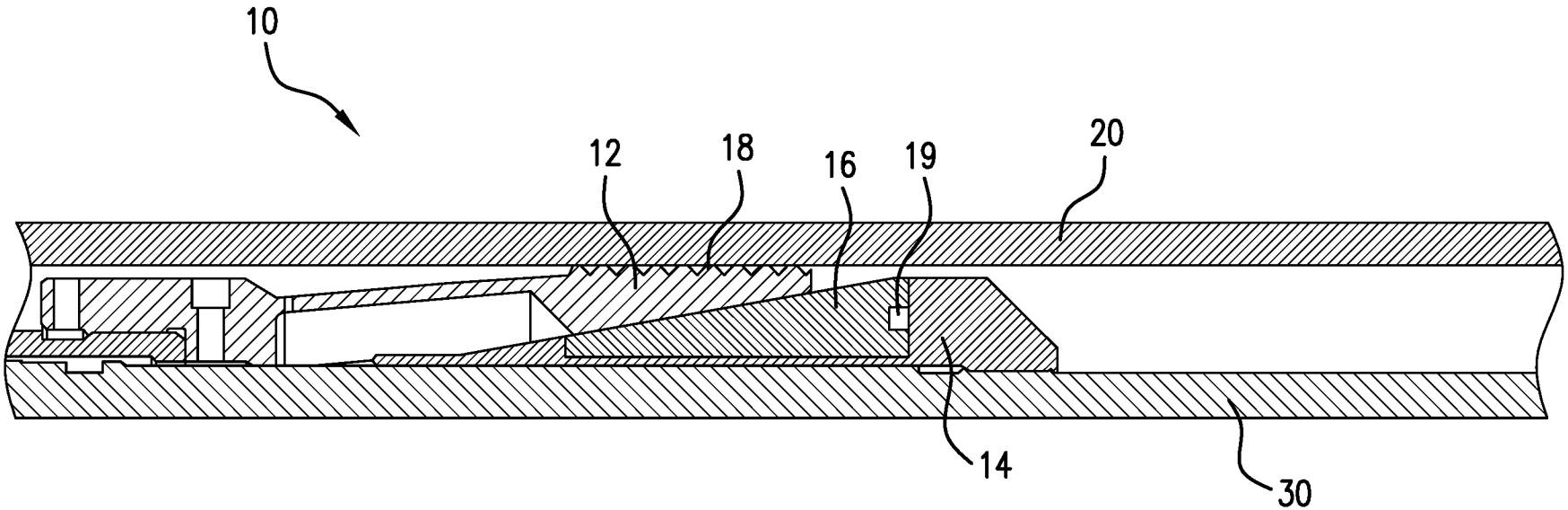
FIG. 1 is a schematic section view of an anchor system as disclosed herein.
Figure 2A:
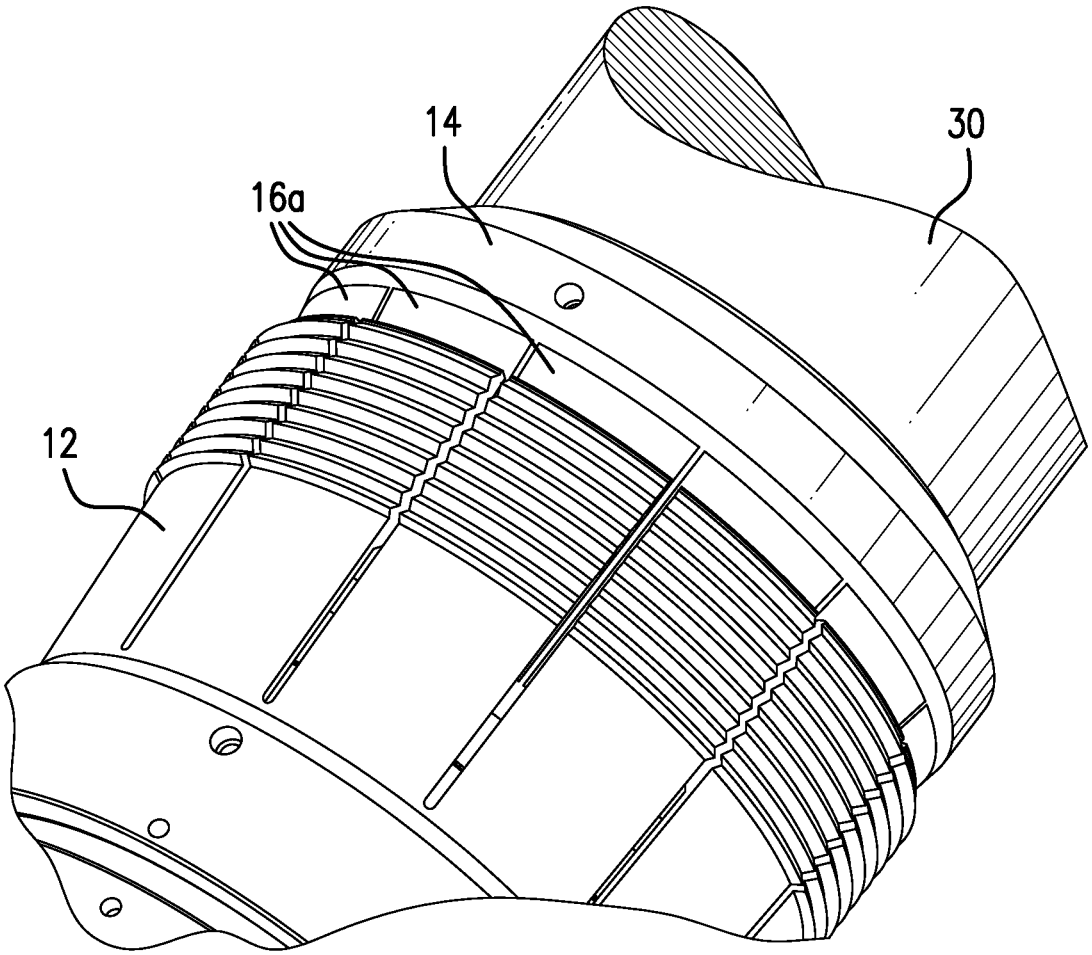
FIG. 2A is a view similar to FIG. 1 that illustrates longitudinally oriented portions of the material.
Figure 2B:
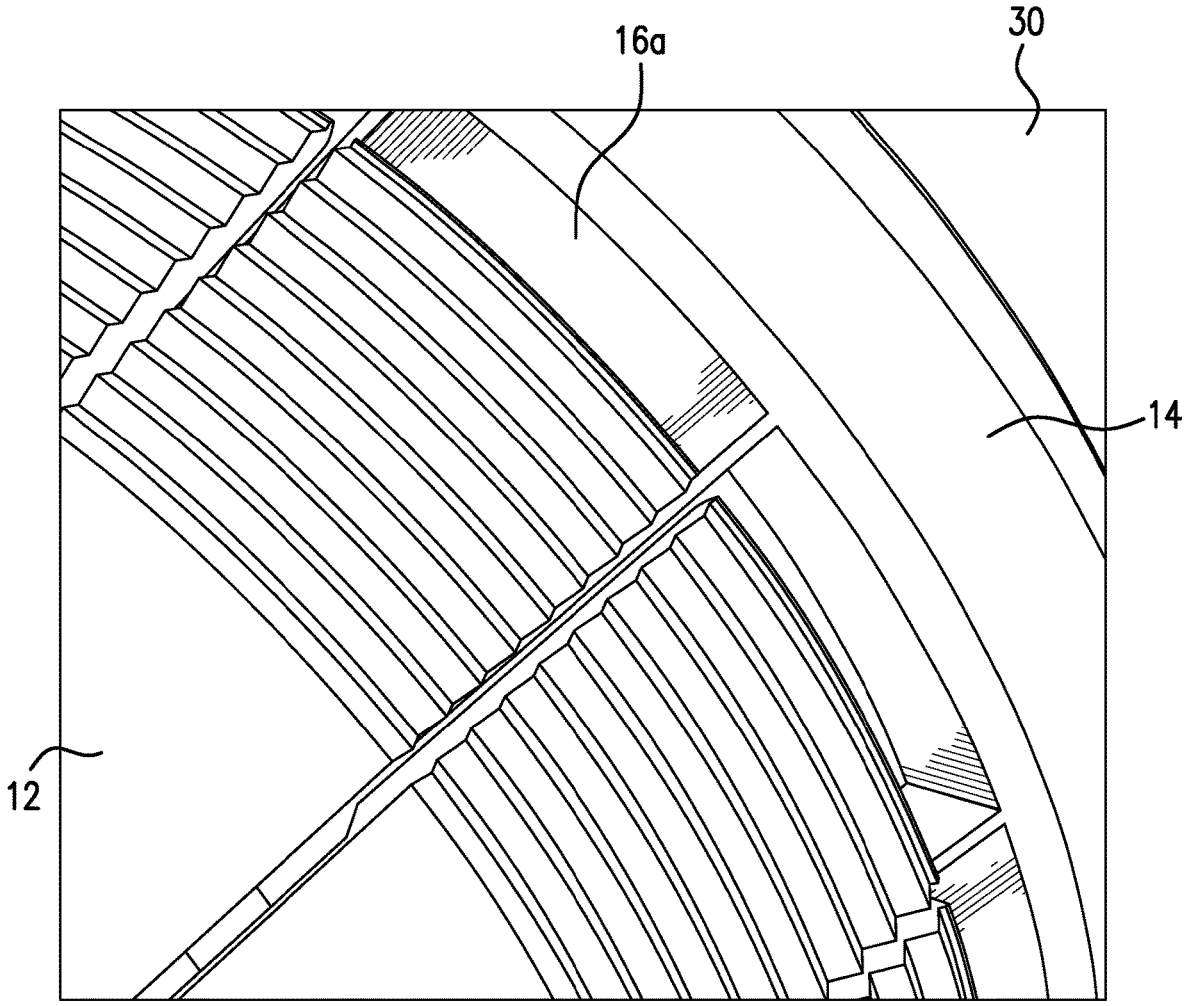
FIG. 2B is a view similar to that of FIG. 2A illustrating a selective reduction in structural integrity of only one of the longitudinally oriented portions to promote flow through the cone.

Referring to FIGS. 1 and 2 (i.e., 2A and 2B), an anchor system 10 is illustrated. The system 10 includes a slip 12 and a cone 14. The cone 14 is configured to respond to receipt of a signal by reducing its structural integrity. In an embodiment, the cone 14 includes a degradable material 16 such as stressed glass or a chemically or energetically degradeable on demand material commercially available from Baker Hughes, Houston, Texas. In the embodiments of FIGS. 1 and 2, the material 16 directly supports the slips 12. Removal of that material 16 therefore directly unsupports the slips 12.

The material 16 may be disposed about a periphery of the cone 14 in longitudinally oriented portions 16*a* (see FIGS. 2A and B) or may make up an annular portion (see FIG. 1) that makes up a part of the cone 14. The material 16 may then be disposed under one or more of a number of slips 12. Each slip 12 under which the material 16 is disposed will become unsupported upon the degradation of the material 16. In some cases, this will be all of the slips 12 so that the system 10 may be retrieved, while in other cases this may be only some of the slips 12. In the latter case, it will have been determined that a subset of the slips 12 are sufficient to hold any load placed on the system 10 and the material 16*a* at portions of the area of the cone 14 may be selectively degraded to provide for a flow path past the cone 14.

For all slips 12 that are subjacently unsupported by the degradation of material 16, the slip 12 may move radially inwardly, thereby disengaging wickers 18 of the slip 12 with the tubular structure 20 in which they are set. By disengaging the wickers 18, the required tensile load to retrieve the system 10 is far less than it would be if the wickers 18 remained engaged with the structure 20 when retrieval operations begin.

Material 16 is configured to receive a signal that may for example come from surface or may come from a controller in the downhole environment, the signal configured to create the desired response in the material 16. In an embodiment, the signal is received by a trigger 19 that ignites the material 16, while in another embodiment, the signal causes a mechanical load to be applied to a susceptible area of the stressed glass material, such as a tail of a prince Rupert's drop, also schematically identified with numeral 19. In either case, the material 16 loses structural integrity at least and disappears altogether through ignition or flowing away in some embodiments. Regardless of which thing occurs, it will be appreciated that the slip 12 being supported thereby will lose radial support at that time and tend to move radially inwardly of the system 10.

Figure 3:
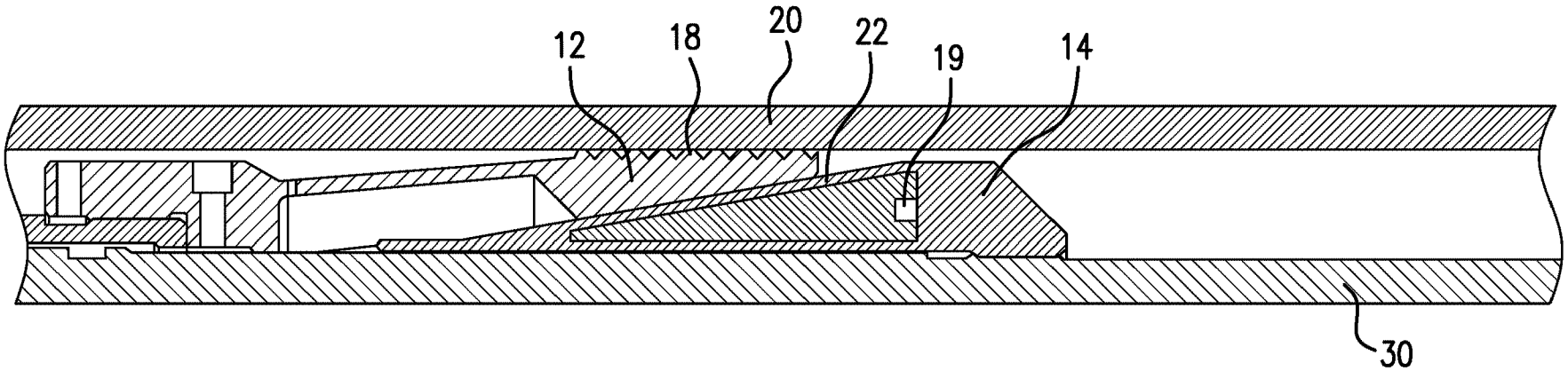
FIG. 3 is an alternate embodiment of an anchor system as disclosed herein.

Referring now to FIG. 3, an alternate embodiment of the system 10 is illustrated. In this embodiment, the material 16 is not directly supportive of the slip 12 but rather is supportive indirectly through a slip support surface 22. Surface 22 will not itself disappear upon receipt of the signal but rather will be subject to flex when the subjacent support is removed therefrom due to degradation of material 16. The same materials are contemplated for use in this embodiment. It will be appreciated however that if stressed glass is used in this embodiment, there must be some volume within the cone 14 for particulate residue of a degraded stressed glass to migrate in order to unsupport the surface 22. Where the chemical or energetic degrade on demand material from Baker Hughes is used, no such provision must be made as at least a portion of that material will become a gas and hence will allow the surface 22 to become unsupported for that reason.

Figure 4:
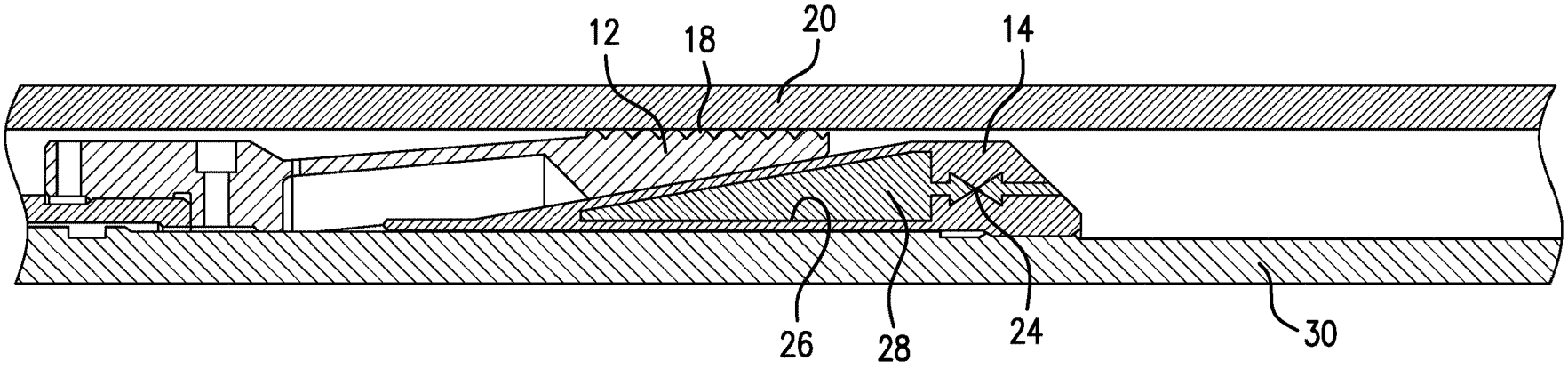
FIG. 4 is another alternate embodiment of an anchor system as disclosed herein.

Referring to FIG. 4, another embodiment is illustrated where the cone 14 includes a valve 24 that selectively opens or closes a volume 26 within the cone 14. This embodiment retains the surface 22 but that surface is supported by a fluid material 28 disposed in the volume 26. The material 28 may be a liquid such as a hydraulic oil for example, or may be a flowable particulate matter that flows like a liquid. In either case, the fluid material 28 is used to fill the volume 26 and be at least essentially incompressible therein to support the support surface 22 and yet be exhaustable from the volume 26 through the valve 24 upon receipt of a signal at the cone 14. When the valve 24 is opened, for example by a solenoid (not shown) or similar, or by dissolution of a plug constructed of a dissolve on demand material, after receiving an electromagnetic or electrical signal, the fluid will flow out of the cone 14, denying the surface 22 its subjacent support. Accordingly, the surface 22 will deflect and the slips 12 will be allowed to move radially inwardly to an extend that causes the wickers 18 to disengage the structure 20. Retrieval is facilitated as was described above.

Any of the embodiments disclosed herein may be disposed upon a mandrel 30, which itself may be a part of a string 46.

Figure 5:
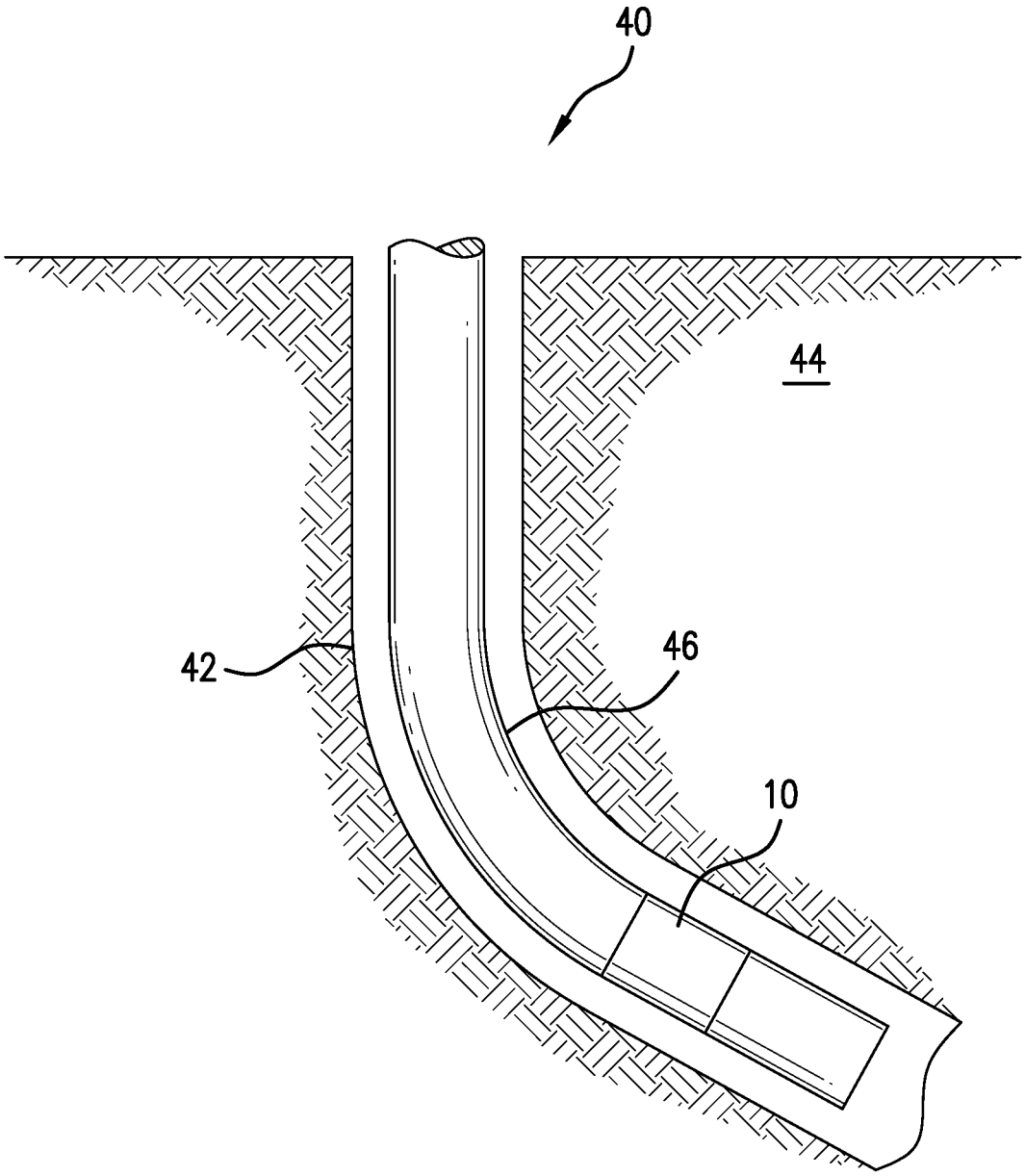
FIG. 5 is a view of a borehole system including an anchor system as disclosed herein.

Referring to FIG. 5, a borehole system 40 is illustrated. The system 40 comprises a borehole 42 in a subsurface formation 44. The string 46 is disposed within the borehole 42. An anchor system 10 as disclosed herein is disposed within or as a part of the string 46.

Set forth below are some embodiments of the foregoing disclosure:

Embodiment 1: An anchor system including a slip, and a cone supportive of the slip in a set position, the cone being configured to reduce structural integrity thereof upon receipt of a signal.

Embodiment 2: The system as in any prior embodiment, wherein the cone comprises a degrade on demand material.

Embodiment 3: The system as in any prior embodiment, wherein the degrade on demand material is located at one or more intervals in a circumferential direction about the cone.

Embodiment 4: The system as in any prior embodiment, wherein the degrade on demand material at intervals when degraded provides a fluid pathway past the cone.

Embodiment 5: The system as in any prior embodiment, wherein the cone consists of a degrade on demand material.

Embodiment 6: The system as in any prior embodiment, wherein the cone comprises a stressed glass material.

Embodiment 7: The system as in any prior embodiment, wherein the cone includes a slip support surface.

Embodiment 8: The system as in any prior embodiment, wherein a volume of the cone subjacent the slip support surface is where the cone is subject to reduced structural integrity upon receipt of the signal.

Embodiment 9: The system as in any prior embodiment, wherein the volume is a degrade on demand material.

Embodiment 10: The system as in any prior embodiment, wherein the volume is a stressed glass material.

Embodiment 11: The system as in any prior embodiment, wherein the volume is a cavity of the cone fillable with a fluid to provide support to the slip support surface, the cone including an openable valve therein to release fluid from the volume upon receipt of the signal.

Embodiment 12: The system as in any prior embodiment, wherein the valve is a dissolvable plug.

Embodiment 13: The system as in any prior embodiment, wherein the fluid is a liquid.

Embodiment 14: The system as in any prior embodiment, wherein the fluid is a particulate solid.

Embodiment 15: A method for operating an anchor including sending a signal to an anchor as in any prior embodiment, and reducing the structural integrity of the cone.

Embodiment 16: The method as in any prior embodiment, further including unsupporting the slip.

Embodiment 17: The method as in any prior embodiment, further including withdrawing the anchor.

Embodiment 18: The method as in any prior embodiment, wherein the reducing is degrading.

Embodiment 19: The method as in any prior embodiment, wherein the reducing is flowing a fluid out of the cone.

Embodiment 20: A borehole system including a borehole in a subsurface formation, a string in the borehole, and an anchor as in any prior embodiment, disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of +8% a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An anchor system comprising:

a slip; and a cone defining a slip contact surface and defining an interior volume, the interior volume initially containing a support material that maintains the slip contact surface in an unflexed condition, the support material being degradable or migratable upon receipt of a signal, the support material degrading or migrating to unsupport the slip contact surface of the cone, where during use, flex of the slip contact surface facilitates movement of the slip radially inwardly of the system.

2. The system as claimed in claim 1, wherein the cone comprises a degrade on demand material.

3. The system as claimed in claim 2, wherein the degrade on demand material is located at one or more intervals in a circumferential direction about the cone.

4. The system as claimed in claim 3, wherein the degrade on demand material at intervals when degraded provides a fluid pathway past the cone.

5. The system as claimed in claim 1, wherein the cone consists of a degrade on demand material.

6. The system as claimed in claim 1, wherein the cone comprises a stressed glass material.

7. The system as claimed in claim 1, wherein the cone includes a slip support surface.

8. The system as claimed in claim 7, wherein a volume of the cone subjacent the slip support surface is where the cone is subject to reduced structural integrity upon receipt of the signal.

9. The system as claimed in claim 8, wherein the volume is a degrade on demand material.

10. The system as claimed in claim 8, wherein the volume is a stressed glass material.

11. The system as claimed in claim 8, wherein the volume is a cavity of the cone fillable with a fluid to provide support to the slip support surface, the cone including an openable valve therein to release fluid from the volume upon receipt of the signal.

12. The system as claimed in claim 11, wherein the valve is a dissolvable plug.

13. The system as claimed in claim 11, wherein the fluid is a liquid.

14. The system as claimed in claim 11, wherein the fluid is a particulate solid.

15. A method for operating an anchor, comprising:

sending a signal to an anchor as claimed in claim 1; and reducing the structural integrity of the cone.

16. The method as claimed in claim 15, further including: unsupporting the slip.

17. The method as claimed in claim 16, further including: withdrawing the anchor.

18. The method as claimed in claim 15, wherein the reducing is degrading.

19. The method as claimed in claim 15, wherein the reducing is flowing a fluid out of the cone.

20. A borehole system comprising:

a borehole in a subsurface formation;

a string in the borehole; and an anchor as claimed in claim 1, disposed within or as a part of the string.

* * * * *